United States Patent [19]

Köprunner

[11] Patent Number: 4,585,054

[45] Date of Patent: Apr. 29, 1986

[54] CONDENSATE DRAINING SYSTEM FOR TEMPERATURE REGULATED STEAM OPERATED HEAT EXCHANGERS

[76] Inventor: Ernst Köprunner, Bogendorf 13, A-5145 Neukirchen, Austria

[21] Appl. No.: 609,669

[22] Filed: May 14, 1984

[51] Int. Cl.[4] ..... F28B 1/00; F28B 9/10

[52] U.S. Cl. ..... 165/112; 60/692; 165/110; 237/9 R

[58] Field of Search ..... 237/9 R, 10, 65, 67; 60/686, 690, 692; 165/110, 111, 112, 113, 114

[56] References Cited

U.S. PATENT DOCUMENTS

| | | | |
|---|---|---|---|
| 1,710,733 | 4/1929 | Hodgkinson | 165/113 |
| 3,813,037 | 5/1974 | Bekedam | 237/9 R |
| 3,852,162 | 12/1974 | Light | 165/111 X |
| 4,019,680 | 4/1977 | Norris | 239/9 R |
| 4,065,056 | 12/1977 | Regamey | 60/692 X |
| 4,177,767 | 12/1979 | Regamey | 122/456 |

FOREIGN PATENT DOCUMENTS

| | | | |
|---|---|---|---|
| 224209 | 7/1910 | Fed. Rep. of Germany | 237/10 |

*Primary Examiner*—William R. Cline
*Assistant Examiner*—Randolph A. Smith
*Attorney, Agent, or Firm*—Fleit, Jacobson, Cohn & Price

[57] ABSTRACT

A system for draining condensate from a temperature regulated, steam operated heat exchanger. A buffer tank having a volume at least equal to that of the steam compartment is connected to the steam side of the heat exchanger, and a drain line extends from the bottom of the buffer tank to a condensate collection pipe located above the buffer tank. The drain pipe from the heat exchanger includes an air venting device and a control pipe having a non-return valve linking the top of the tank to the steam side of the heat exchanger. During low load operation of the heat exchanger, air from the top of the buffer tank can flow back to the steam compartment of the heat exchanger to equalize the pressures and permit drainage of the condensate even during low load conditions.

4 Claims, 1 Drawing Figure

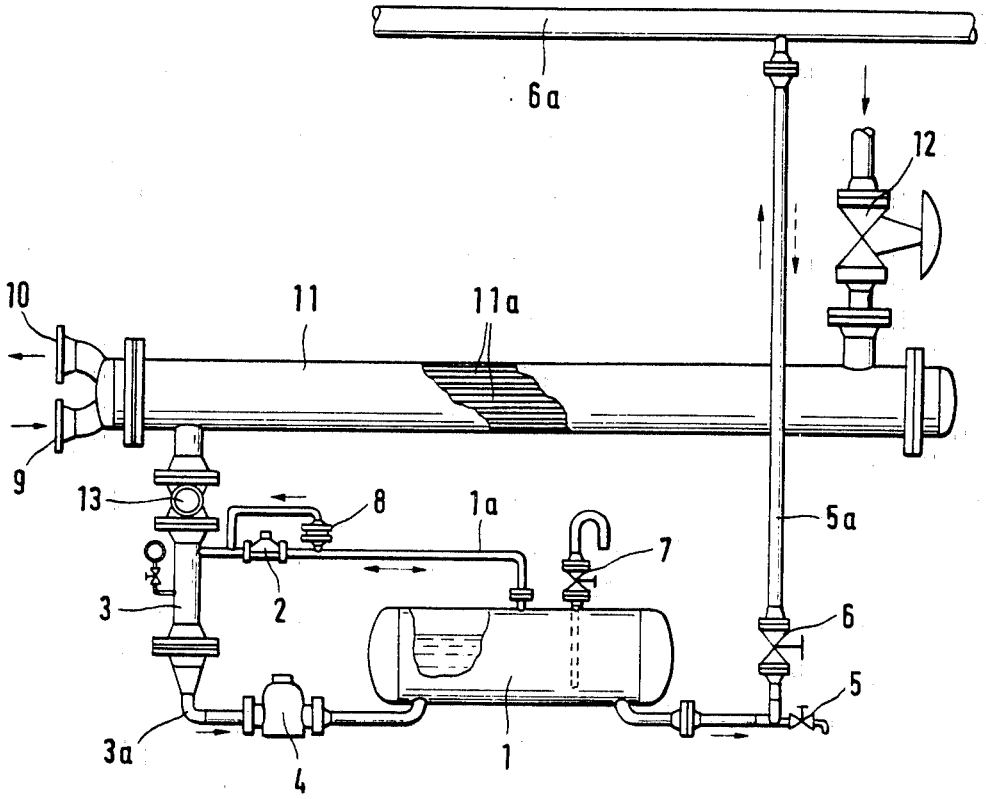
6a
12
10
11
11a
9
13
8
1a
7
5a
3
2
6
5
3a
4
1

CONDENSATE DRAINING SYSTEM FOR TEMPERATURE REGULATED STEAM OPERATED HEAT EXCHANGERS

BACKGROUND OF THE INVENTION

1. Field of the Invention

This invention relates to a condensate draining system for a heat exchanger, and more particularly to a condensate draining system for temperature regulated, steam operated heat exchangers with a condensate drain pipe leading from the condensate exit point of the heat exchanger via a drain incorporating an air venting device to the condensate drain.

2. Description of the Prior Art

Steam condensers or heat exchangers are designed to operate at maximum load, but when running at intermediate loads they operate at less than full efficiency. This can result in lower than atmospheric pressure occurring in the heat exchanger, because with lower performance levels the temperature of the steam is also reduced. Such a situation will present difficulties for condensate removal from closed systems. Since the condensate cannot by itself drain from a space of low pressure to one of high pressure, or even into a high pressure condensate pipe, special equipment is required to remove the condensate. At present this is usually achieved by means of various systems using vacuum breakers. These vacuum breakers take atmospheric air into the equipment to balance the pressures so that the condensate may drain into a non-pressurized space. This solution is not satisfactory because the feeding of the condensate back into the boiler house can only be achieved by expensive siphoning facilities requiring energy input. The constant suction of atmospheric air into the system can also produce corrosion in the heat exchanger and condensate pipes. The draining of the condensate into the waste water system is also a problem, since the condensate, as treated boiler water of relatively high temperature, can corrode and damage earthenware pipes and concrete.

It is also known that condensate can be removed by means of a very deep condensate sump with a condensate drain, e.g., a ball float trap or a capsule trap. However, such arrangements are limited by the available space and other technical considerations. All existing condensate drain systems allow only a limited removal of condensate. This means that where steam comes into contact with the accumulated condensate, some spontaneous condensation will occur. This causes sudden changes in steam pressure which can lead to pipe fracture (especially the bottom of pipes), the cracking of welded joints, and damage to the process control apparatus.

SUMMARY OF THE INVENTION

An object of this invention is to overcome the above-mentioned disadvantages and defects and to achieve the drainage of condensate by means of a system as hereinafter described. This system overcomes the pressure changes resulting from the sudden condensation of the steam, corrosion damage and other problems. It ensures a trouble-free removal of condensate from the heat exchanger.

This invention solves the problems as follows: The outlet for the condensate is connected by a pipe to a buffer tank of at least the capacity of the steam volume of the heat exchanger. This buffer tank is connected by a drain pipe, or the like, from the bottom of the tank to a condensate collection pipe located above the buffer tank. The condensate drain pipe features an air venting device which feeds into the buffer tank. Furthermore, a control pipe with a non-return valve links the top of the tank to the steam compartment of the heat exchanger. Such a system of condensate drainage makes it possible to retain some of the inert gases (i.e., air) entrained in the steam. When required this air can be made to flow back into the steam compartment of the heat exchanger to equalize the pressures. The air, because of its intermediate specific gravity, forms a cushion in the heat exchanger between the steam and the condensate. Thus for every type of installation and throughout all parts of the operation the drainage of the condensate is accomplished. Also, the steam cannot come into contact with the condensate because of the air cushion. This prevents its condensation and provides a safeguard from the sudden pressure changes and the damage that can result. Furthermore, since additional air feeds back into the steam compartment whenever the steam pressure falls, the pressure inside the heat exchanger maintains the steam pressure at maximum operating efficiency. Also, the pressure is maintained at greater than atmospheric pressure, which means that the condensate can be siphoned without extra cost or energy input. Dependent on the steam pressure, the condensate can be piped away under pressure and may be reused as boiler water. The layout of the equipment for the drainage of the condensate described in this invention does not require any special structural or building requirements. It can easily be added to existing heat exchanger systems. An installation of a buffer tank is not absolutely necessary provided that there is available a separate and sufficiently large supply of an inert gas.

If following the installation of the system so far described, a by-pass around the non-return valve is provided that incorporates a thermostatically controlled valve that stops the steam flow, then rapid venting of the heat exchanger is achieved and this allows temperature regulation with minimum delay.

If the condensate outlet described in this invention is connected by means of a condensate sump to the buffer tank, then the overall arrangement of the parts becomes straight-forward and it is simple to install, even at a later date.

BRIEF DESCRIPTION OF THE DRAWING

The various components and their arrangement that constitute the invention are depicted in the schematic diagram.

DESCRIPTION OF THE PREFERRED EMBODIMENTS

A buffer tank (1) is provided for the draining of condensate from a temperature regulated steam operated heat exchanger (11). The capacity of the buffer tank is at least that of the volume of the steam compartment of the heat exchanger (11). The condensate sump (3) of the heat exchanger (11) is connected to the buffer tank (1) by means of a condensate drainage pipe (3A). This pipe (3A) leads to the condensate outlet (4) with its air venting device feeding into the buffer tank (1). This tank (1) has a drain cock (5) for emptying and is connected via a valve (6) to a condensate collection pipe (6A) running above the buffer tank (1). Furthermore, a control pipe (1A) runs back from the top part of the buffer tank (1)

to the steam compartment of the heat exchanger (11). The control pipe (1A) has a non-return valve (8) and in the by-pass section a thermostatically controlled valve (2) for the steam.

Water for the heat exchanger (11) enters at pipe (9) and leaves it at pipe (10). While flowing through the heat exchanger the steam heats the water to the set temperature. The steam itself flowing into the steam compartment (11A) is controlled by a temperature regulator (12). As a result of transferring its energy content to the water, some of the steam condenses and the condensate collects in the sump (3). This causes a change in steam pressure and temperature inside the heat exchanger. Therefore, depending on the performance required from the heat exchanger, the pressure in the steam compartment (11A) can either be greater than atmospheric pressure or, if the heating load is light, the pressure can become less than the atmospheric pressure.

The contents of the buffer tank (1) are subjected to a fixed hydrostatic pressure through the drain pipe (5A) and the condensate collecting pipe (6A) whenever the drain cock (5) is closed and the valve (6) is in the open position. The condensate collection pipe (6A) is vented and the pressure is released in a central return feed plant not shown on the diagram. If the steam pressure inside the heat exchanger (11) falls below that maintained in the buffer tank (1), the collected inert gases from the buffer tank (1) will flow via the control pipe (1A) and through the non-return valve (8) into the condensate sump (3) and from there into the steam compartment (11A) of the heat exchanger (11). At the same time the condensate will flow from the condensate collection pipe (6A) back into the buffer tank (1). While this is occurring, condensate from the heat exchanger (11) also drains via the condensate sump (3) to the condensate outlet (4) without hindrance. The sight glass (13) allows this process to be visually monitored. If the steam pressure rises in the heat exchanger as a result of greater performance demands, the inert gases are returned to the buffer tank (1) via the control pipe (1A) through the thermostatically controlled valve (2). This valve remains open until the steam enters the pipe (1A); it then shuts the path to the buffer tank (1). The remaining inert gases can increase pressure flow via the condensate sump (3) to the condensate outlet (4) and the air vent (7) and from there also into the buffer tank (1). This process can repeat itself as often as is necessary since the inert gases entrained in the steam are collected and stored in the buffer tank (1).

Larger volumes of air introduced into the system through maintenance work on the steam pipes, shutdowns, changeovers, or start-ups, can escape without hindrance via the drain pipe (5A) and into the condensate collection pipe system (6A). To empty the buffer tank (1) the air vent (7) is opened and with the stop valve (6) shut the drain cock (5) is opened to allow the contents of the tank to drain away. To fill the buffer tank (1) the air vent (7) and the drain cock (5) are closed and the valve (6) is opened. Condensate will now flow from the condensate collection pipe (6A) into the tank until a certain hydrostatic pressure has been built up.

What is claimed is:

1. A condensate draining system for a temperature regulated, steam operated heat exchanger having a steam compartment, a steam inlet and a steam condensate outlet, said draining system comprising: a buffer tank; a first condensate drainage pipe extending from the heat exchanger to the buffer tank; a condensate outlet positioned in the condensate drainage pipe; air venting means connected to the condensate outlet of the heat exchanger, the air venting means including a gas control pipe extending from an upper part of the buffer tank to the heat exchanger steam condensate outlet to permit introducing directly into the steam compartment of the heat exchanger a non-condensing gas having a higher specific gravity than that of steam within the heat exchanger and a higher pressure than atmospheric pressure, and a non-return valve positioned in the gas control pipe; a condensate collection pipe positioned above the buffer tank; and a second condensate drain pipe extending from the condensate collection pipe to a lower part of the buffer tank.

2. A condensate draining system according to claim 1 wherein the gas control pipe includes a thermostatically controlled valve to bypass the non-return valve and provide communication between the upper part of the buffer tank and the heat exchanger steam outlet.

3. A condensate draining system according to claim 1 wherein the buffer tank has a volume at least as large as the volume of the steam compartment of the heat exchanger.

4. A condensate draining system according to claim 1 wherein the first condensate drainage pipe is positioned below the non-return valve.

* * * * *